US006926195B1

(12) United States Patent
Rhyne et al.

(10) Patent No.: US 6,926,195 B1
(45) Date of Patent: Aug. 9, 2005

(54) BOX WITH TAB CLOSURES

(75) Inventors: Edward Rhyne, Painted Post, NY (US); Jonathan Videtti, Sharpsburg, MD (US)

(73) Assignee: World Kitchen (GHC), LLC, Reston, VA (US)

( * ) Notice: Subject to any disclaimer, the term of this patent is extended or adjusted under 35 U.S.C. 154(b) by 0 days.

(21) Appl. No.: 10/604,992

(22) Filed: Aug. 29, 2003

(51) Int. Cl.[7] ..... B65D 5/42

(52) U.S. Cl. ..... 229/149; 229/155; 229/158; 229/185; 229/194; 229/198.2

(58) Field of Search ..... 229/148, 149, 229/155, 158, 185, 190, 194, 198.2, 125.28, 229/125.29

(56) References Cited

U.S. PATENT DOCUMENTS

| | | | | | |
|---|---|---|---|---|---|
| 1,131,462 | A | * | 3/1915 | Bergstein | 229/177 |
| 1,324,144 | A | * | 12/1919 | Cone | 229/198.2 |
| 1,468,696 | A | * | 9/1923 | Bray | 229/190 |
| 1,765,964 | A | * | 6/1930 | Berton | 229/149 |
| 2,120,470 | A | * | 6/1938 | Patterson | 229/198.2 |
| 2,309,134 | A | * | 1/1943 | Morgan | 229/194 |
| 2,481,871 | A | | 9/1949 | Potts | |
| 2,643,047 | A | * | 6/1953 | O'Reilly | 229/148 |
| 2,757,849 | A | | 8/1956 | Duff | |
| 2,827,222 | A | | 3/1958 | Buttery | |
| 2,973,129 | A | * | 2/1961 | Stone et al. | 229/185 |
| 3,426,955 | A | * | 2/1969 | Olson | 229/155 |
| 3,580,482 | A | | 5/1971 | Witte | |
| 3,616,989 | A | * | 11/1971 | Martinek et al. | 229/190 |
| 3,734,392 | A | | 5/1973 | Clark | |
| 3,741,079 | A | * | 6/1973 | Bossons et al. | 493/350 |
| 3,809,310 | A | * | 5/1974 | VanderLugt, Jr. | 229/155 |
| 3,812,958 | A | * | 5/1974 | Samsing | 229/185 |
| 3,822,822 | A | * | 7/1974 | Arneson | 229/185 |
| 3,953,634 | A | * | 4/1976 | Wootten | 229/194 |
| 4,058,250 | A | | 11/1977 | Akkerman | |
| 4,139,146 | A | | 2/1979 | Bamburg et al. | |
| 4,157,755 | A | | 6/1979 | Gough | |
| 4,717,070 | A | | 1/1988 | Taub | |
| 5,004,147 | A | | 4/1991 | Bienaime | |
| 5,133,124 | A | * | 7/1992 | Burroughs | 29/403.1 |
| 5,295,631 | A | | 3/1994 | McClure | |
| 5,350,109 | A | | 9/1994 | Brown et al. | |
| 6,135,347 | A | | 10/2000 | Mueller | |
| 6,289,651 | B1 | | 9/2001 | Le Bras | |
| 6,474,541 | B1 | | 11/2002 | Chu | |

FOREIGN PATENT DOCUMENTS

| | | | | |
|---|---|---|---|---|
| DE | 4314703 | A1 | * 11/1994 | 229/190 |

* cited by examiner

*Primary Examiner*—Gary E. Elkins
(74) *Attorney, Agent, or Firm*—Seyfarth Shaw LLP

(57) ABSTRACT

A retaining structure for securing first and second flaps of a box structure in an overlapping, closed condition comprising a first tab pliably coupled to the first flap and defining a free end having a substantially circular shape and an a complementary aperture having a shape and size substantially the same as the free end and disposed in substantial alignment with the free end when the first and second flaps are in the overlapping condition. The tab and aperture cooperate when the tab is pivoted so as to be retainably received by the aperture.

6 Claims, 5 Drawing Sheets

BOX WITH TAB CLOSURES

BACKGROUND OF INVENTION

The present invention relates generally to retaining structures for overlapping sheets of material and, more particularly, to an apparatus for retaining first and second flaps of a storage box in a closed, overlapping condition.

It is well known that integral retaining or locking tabs can be used to retain overlapping flaps, such as in a box. Typically, rectangular tabs are hingedly coupled to a first flap by a folding line and thus defines a free end. A complementary aperture for receiving the tab is typically disposed on an overlapped second flap wherein the tab and aperture cooperate to retain the flaps in an overlapped condition. However, such a tab has a tendency to easily slip and thus disengage, allowing the flaps to become disengaged and pull apart.

It is further well known that if the tab has a shape slightly larger than or modified compared to the complementary aperture, the tab may be more securely held in its retaining condition. This has been accomplished by utilizing a rectangular aperture and a tab having a substantially trapezoidal shape. As such, the tapered edges of the trapezoid provide enhanced friction with the edges of the rectangular aperture due to their slightly larger size. However, a limitation of such a design is the added cost and complexity to manufacturing since separate die and punch processes must respectively be used for the flap and the aperture.

SUMMARY OF INVENTION

The present application discloses a tab closure for retainably securing first and second overlapping flaps, such as commonly used to close an open end of a box. The tab is coupled to the first flap with a pivoting structure and includes a free end defining a part-circular shape with a circumferential outer edge. A complementary aperture having a peripheral edge is disposed on the second flap in substantial alignment with the free end of the first tab when the flaps are overlapping. When the tab is pivoted so as to be inserted within the aperture, the peripheral edge abuts the outer edge at two locations on the free end defining a chord therebetween having a length less than the diameter of the free end and disposed between the diameter and pivoting structure. In such a condition, the free end and aperture cooperatively retain the upper and lower flaps in an overlapped condition by resisting an outwardly directed force.

BRIEF DESCRIPTION OF DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages, should be readily understood and appreciated.

DETAILED DESCRIPTION

Figures 1, 2:
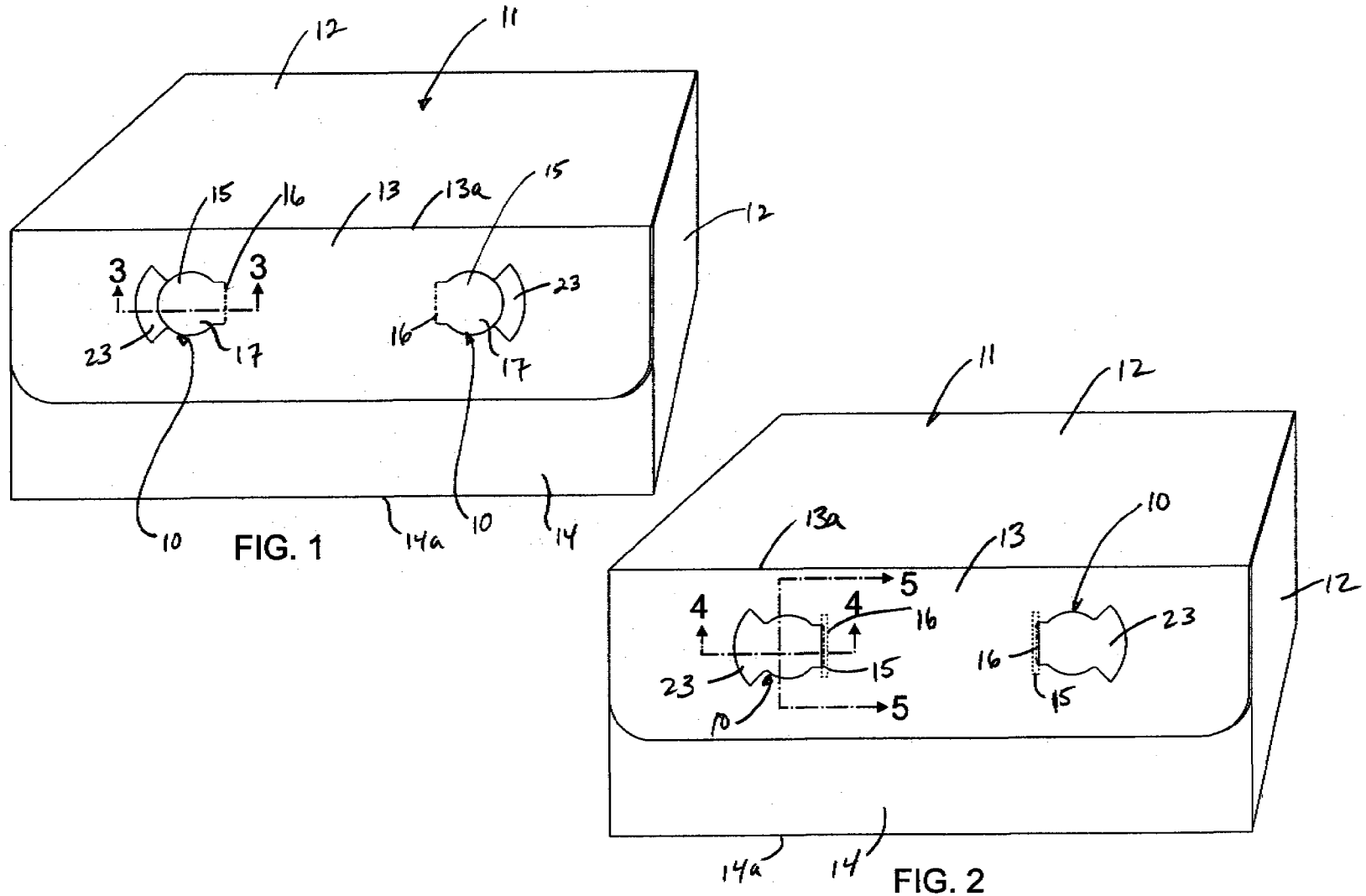
FIG. 1 is a perspective view of a box incorporating the tab closure structure of the present application in a normal unretained position.
FIG. 2 is a side view of the box depicted in FIG. 1 with the tab closure structure in a retaining position.
Figure 3:
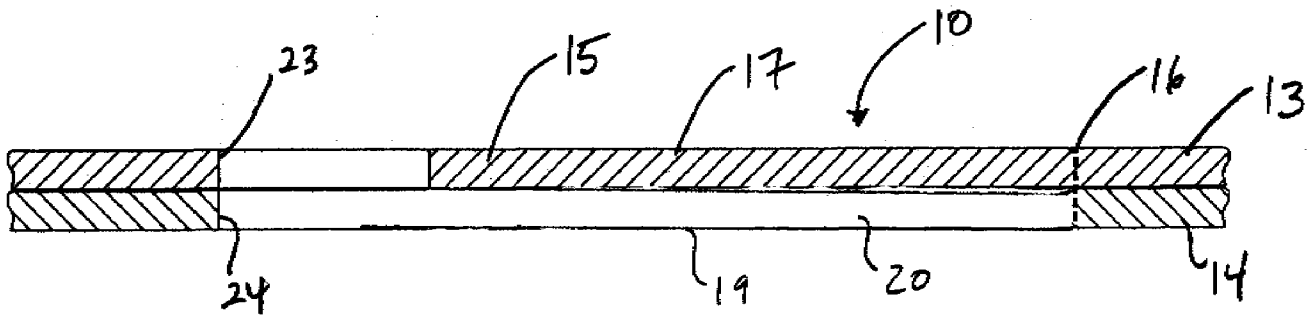
FIG. 3 is an enlarged, fragmentary sectional view taken along line 3—3 in FIG. 1.

The present application discloses a tab closure structure for retainably securing first and second overlapping flaps to each other. Such flaps may respectively be foldably coupled to a wall adjacent to an opening of a box structure wherein the first flap can be folded on top of the second flap in a substantially overlapping condition.

Referring to the figures, the tab closure structure 10 is shown on a box structure 11. The box structure 11 may have a cavity with an open end defined by a plurality of sidewalls 12 that extend from a substantially closed bottom portion. The box structure 11 may comprise a unitary, one-piece wall structure that is openable at one end with respective first and second flaps adjacent to the end and foldable to an overlapping condition for closing the end.

It will be appreciated that while the tab closure structure of the present application has been depicted with a box structure in the figures, the tab closure structure can be used with first and second overlapping sheets of material where it is desired to retainably secure the sheets together. It will further be appreciated that while two tab closure structures 10 have been depicted in the box structure 11, each tab closure structure 10 operates independently and, thusly, any number of tab closure structures 10 of the present application can be used while still achieving the desired results. As such, a pair of tab closure structures 10 have been depicted for exemplification purposes only and shall not be construed as limiting the true scope and spirit of the present application.

At least one sidewall 12 has a first flap 13 foldably coupled thereto along a fold line 13*a* adjacent to the open end and opposite sidewall 12 has a second flap 14 foldably coupled thereto along a fold line 14*a* adjacent to the open end, the first flap 13 being foldable on top of the second flap 14 to define a closed, overlapping condition (FIGS. 1–6).

Figure 4:
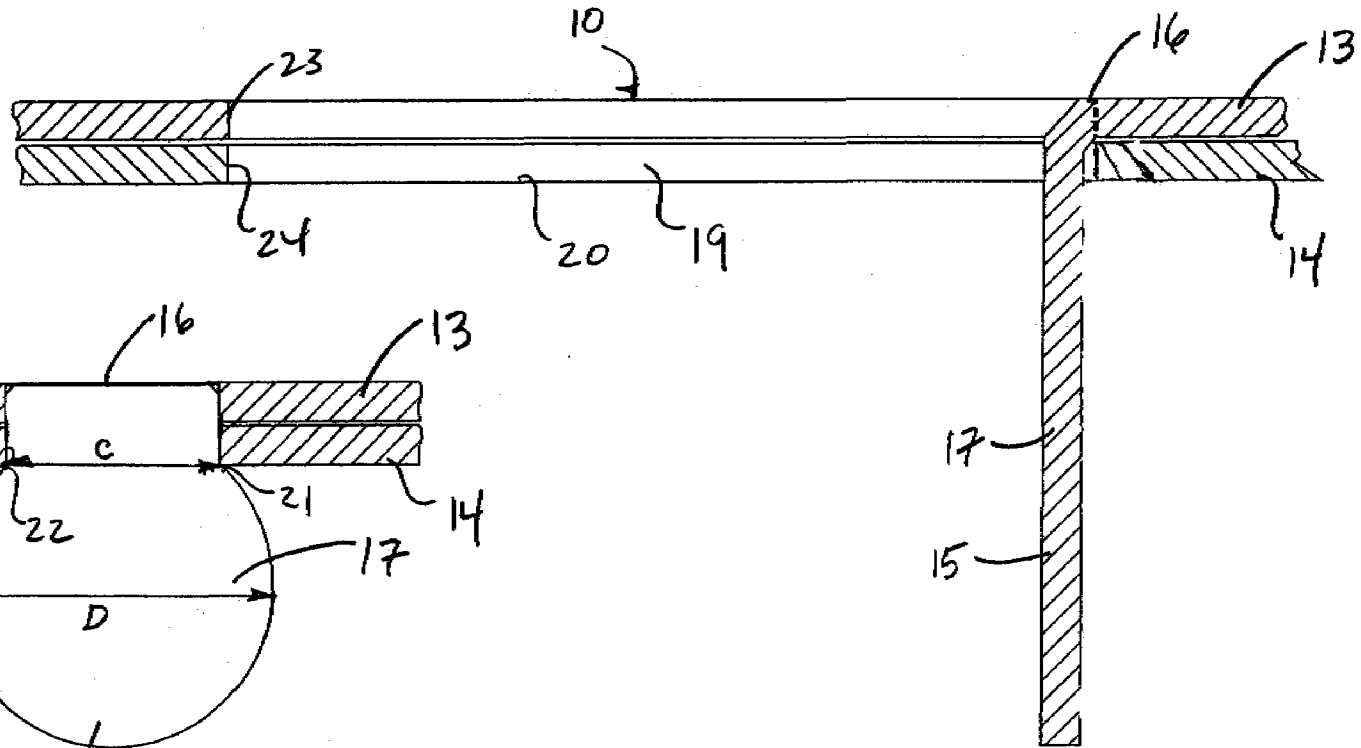
FIG. 4 is an enlarged fragmentary sectional view taken along line 4—4 in FIG. 2.
Figure 5:
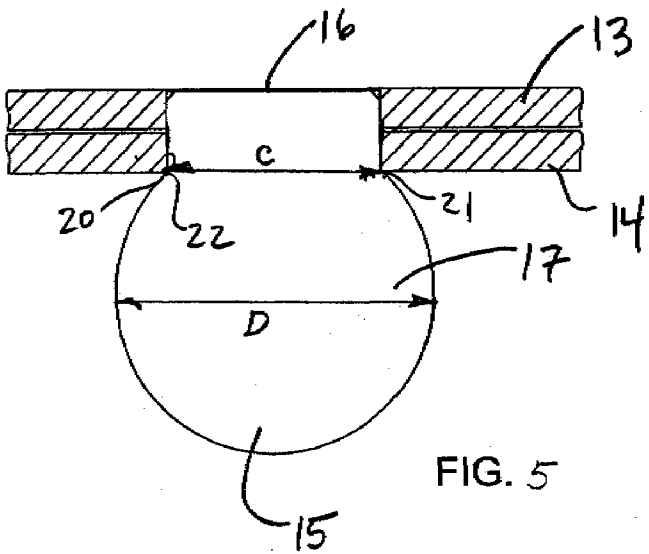
FIG. 5 is an enlarged fragmentary sectional view taken along line 5—5 in FIG. 2.
Figure 7:
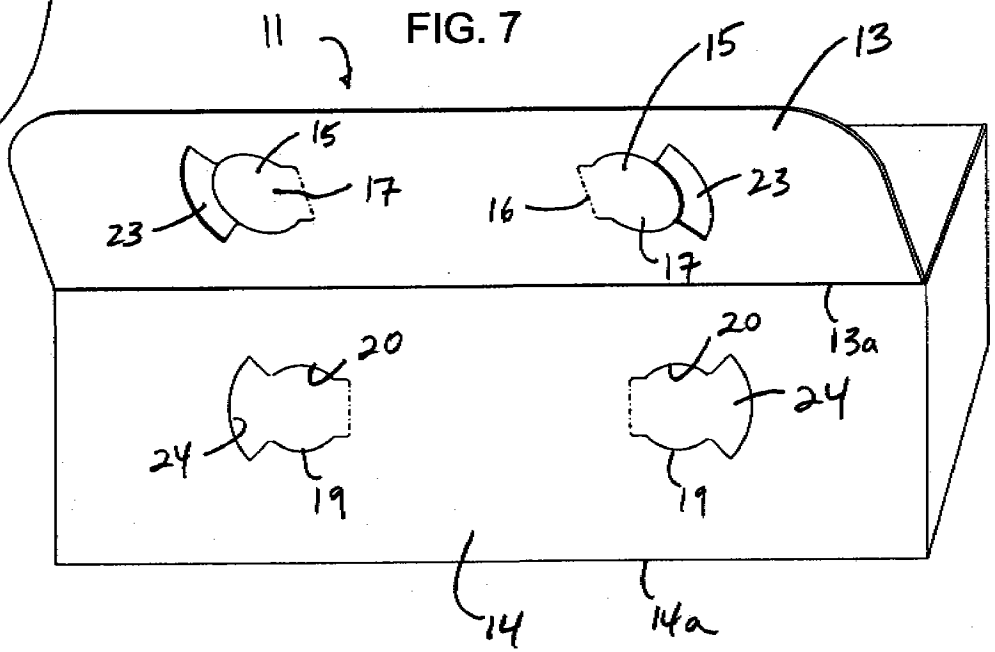
FIG. 7 is a perspective view of the box of FIG. 1 depicting the first and second flaps in a non-overlapping condition.
Figure 6:
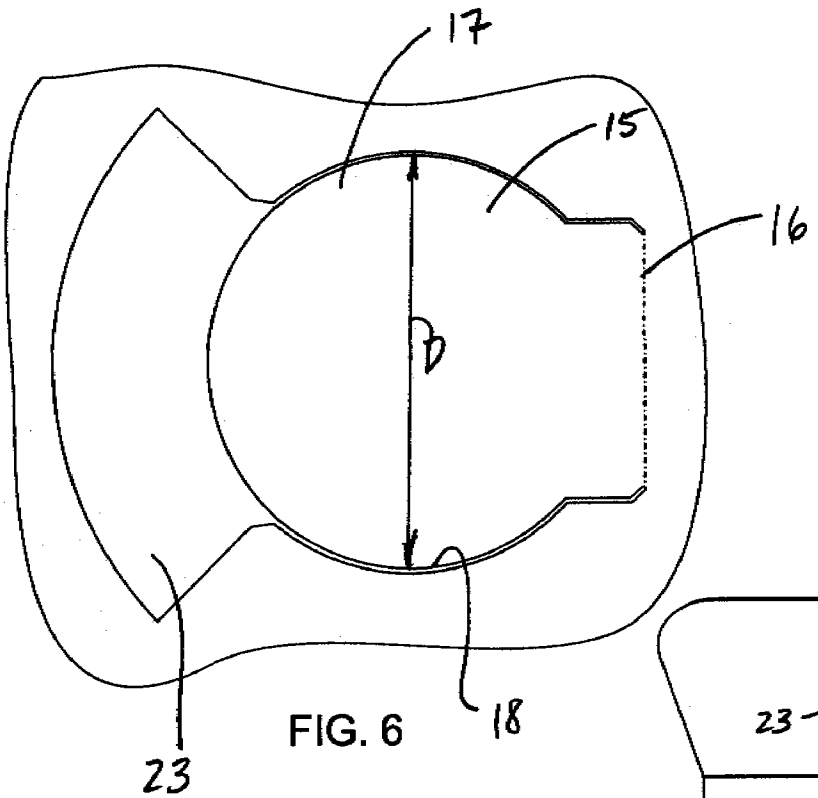
FIG. 6 is an enlarged, top plan view of the tab closure structure of FIG. 1.

The tab closure structure 10 includes a first tab 15 hingedly coupled to the first flap 13 with a pivoting structure 16. The pivoting structure 16 may take the form of a first folding line which may be disposed substantially perpendicular to the fold line 13*a* and adapted to support pivotal movement of the first tab 15. The first tab 15 has a substantially free end 17 defining a part-circular shape having a diameter D (FIG. 5) and a circumferential outer edge 18. The first tab 15 is pivotal out of the plane of the first flap 13 to a substantially perpendicular position relative to the first flap 13 when the first flap 13 is disposed in the closed, overlapping condition, thereby defining a retaining position (as shown in FIGS. 2, 4 and 5).

A complementary aperture 19 having a shape and size substantially the same as that of the free end 17 of the first tab 15 is disposed on the second flap 14 in substantial alignment with the free end 17 when the first and second flaps 13, 14 are disposed in the closed, overlapping condition. The aperture 19 includes a peripheral edge 20.

The first tab 15 and peripheral edge 20 of the aperture 19 cooperate to retain the first and second flaps 13, 14 in the closed, overlapping condition when the first tab 15 is pivoted through the plane of the second flap 14 to the retaining position and the outer edge 18 is consequently disposed in substantial abutting relationship with the peripheral edge 20. More particularly, the outer edge 18 and peripheral edge 20 abutment engage at first and second locations 21, 22 on the free end 17 diametrically opposite each other and defining a chord C therebetween (see FIG. 6). The chord C has a length less than the diameter D and is disposed anywhere between the diameter D and pivoting structure 16.

In an embodiment, the first and second flaps 13, 14 may respectively have finger insert apertures 23, 24 that are in respective substantial alignment when the first and second flaps 13, 14 are disposed in the closed, overlapping condition. The finger insert aperture 23 on the first flap 13 is at the opposite end of the free end 17 from the pivoting structure 16. Each finger insert aperture 23, 24 may have a substantially arcuate shape.

Figure 8:
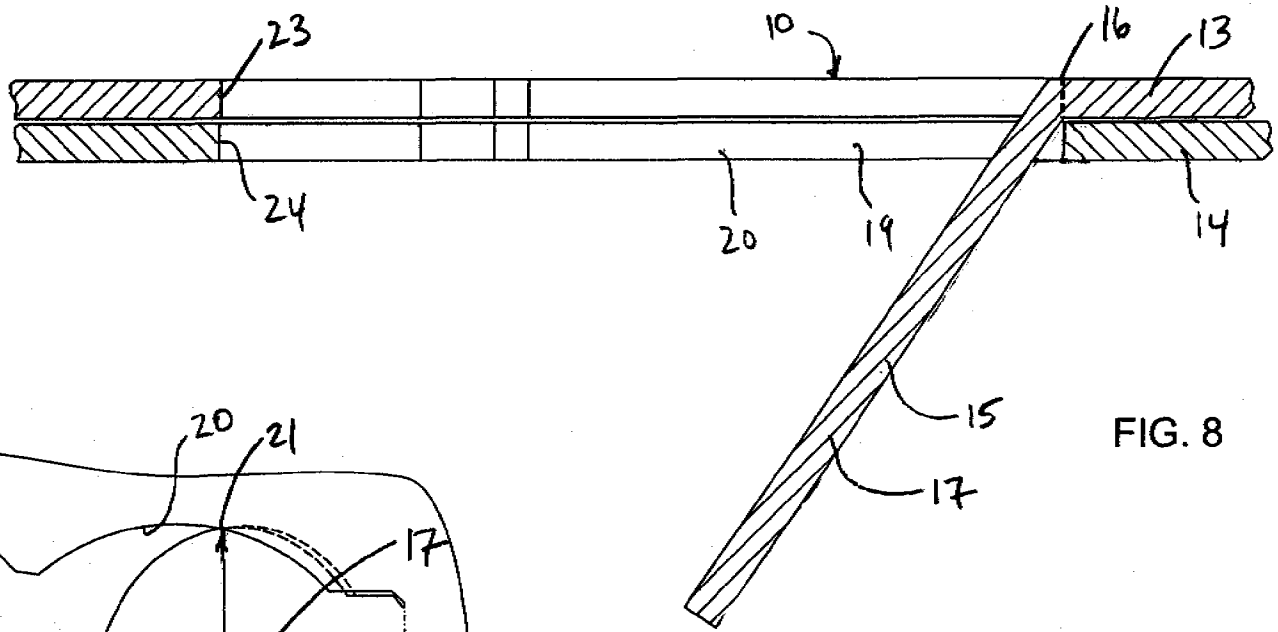
FIG. 8 is an enlarged fragmentary sectional view taken along line 4—4 of FIG. 2 depicting the tab being moved to the retaining position.
Figure 9:
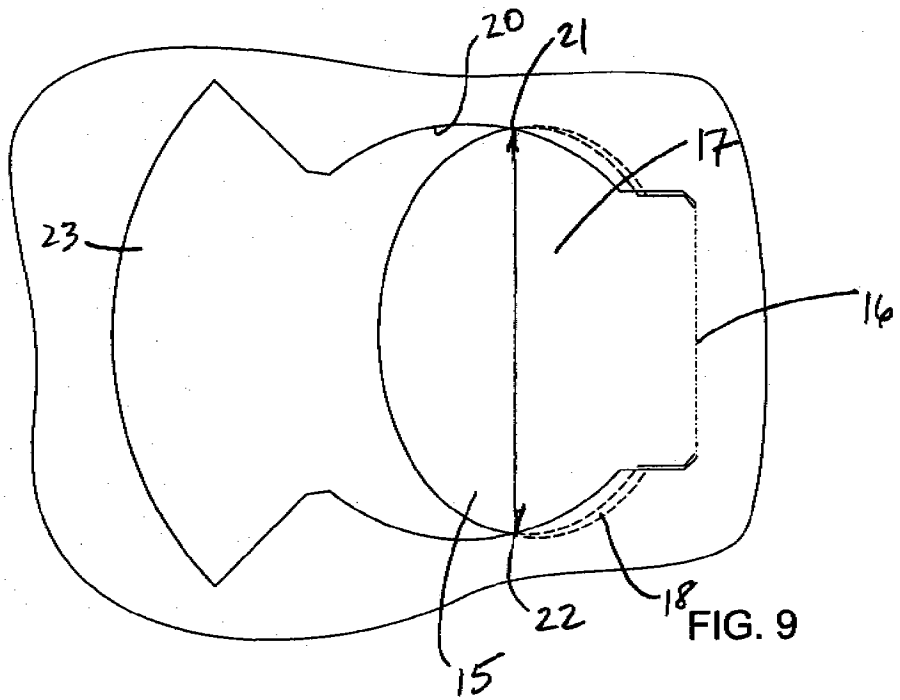
FIG. 9 is an enlarged, top plan view of the tab closure structure of FIG. 1 depicting the tab being moved to the retaining position.

It will be appreciated that while the first tab 15 provides maximum retainability when it is pivoted to a substantially perpendicular position relative to the second flap 14, the first tab 15 and the peripheral edge 20 of the aperture 19 begin to cooperatively retain the first and second flaps 13, 14 in the closed, overlapping condition immediately upon the first tab 15 being moved out of the first plane and into the second plane. Referring to FIGS. 8 and 9, immediately upon moving through the second plane, the outer edge 18 and peripheral edge 20 abutment engage at first and second locations 21, 22 on the free end 17 dramatically opposite each other and defining a chord C, therebetween which has a length less than the diameter D and may be disposed anywhere between the diameter D and pivoting structure 16. The areas of engagement will move toward the pivoting structure 16 as the tab 15 moves toward the retaining positions of FIGS. 2, 4, and 5.

Figure 10:
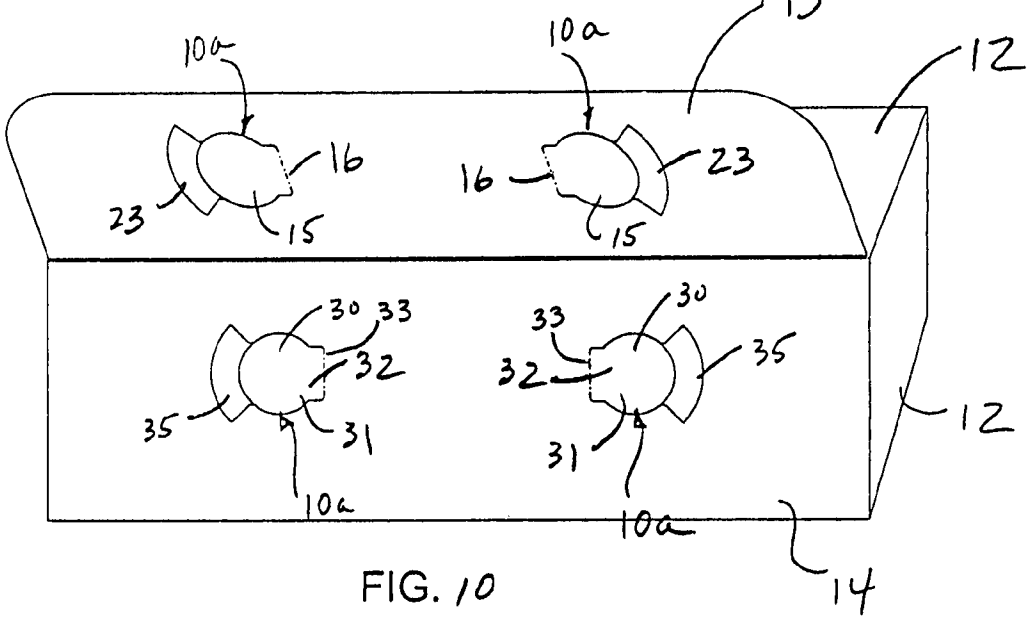
FIG. 10 is a view of a box similar to FIG. 7 depicting the first and second flaps in a non-overlapping condition and incorporating an tab closure structure of the present application.
Figure 11:
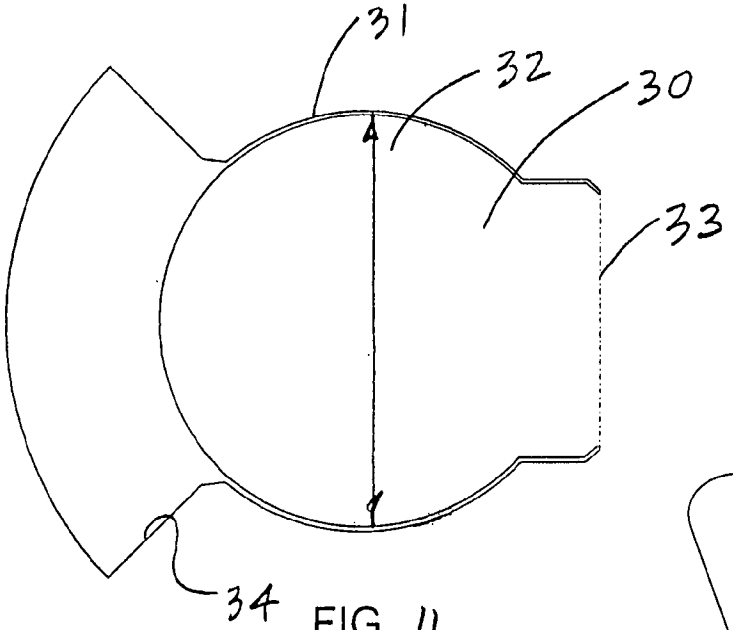
FIG. 11 is an enlarged, top plan view of the tab closure structure of FIG. 8.

Referring to FIGS. 10 and 11, another embodiment of the retaining apparatus of the present application is depicted where the same elements as the previous embodiment have like numerals. A tab closure structure 10*a* includes a first tab 15 that is substantially identical to the tab 15 disclosed above. The tab closure structure 10*a* also includes a second tab 30 disposed on the second flap 14 and thereby defining a complementary aperture 31 having a shape and size substantially similar to those of the first tab 15 and in substantial alignment therewith when the first and second flaps 13, 14 are disposed in the closed, overlapping condition. The second tab 30 is substantially similar to the first tab 15 and includes a free end 32 hingedly coupled to the second flap 14 with a second pivoting structure 33. The second pivoting structure 33 may take the form of a second folding line substantially perpendicular to the fold line 14*a* that is adapted to pivot the second tab 30 between substantially parallel and perpendicular positions relative to the second flap 14. The tab closure structure 10*a* may further include a finger insert aperture 34 that has a substantially arcuate shape and that is disposed at the opposite end of the tab 30 from the second pivoting structure 33 and in substantial alignment with the finger aperture 23 disposed on the first flap 13 when the first and second flaps 13, 14 are disposed in the closed, overlapping condition.

In this embodiment, the first and second tabs 15, 30 are simultaneously disposable in perpendicular positions, relative to the first and second flaps 13, 14. As such, the second tab 30 provides structural support when the first tab 15 cooperates with the complementary aperture 31 to retain the first and second flaps 13, 14 in the closed, overlapping condition as disclosed above.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants" contribution. The actual scope of the protection sought is intended to be defined in the following claims when viewed in their proper perspective based on the prior art.

What is claimed is:

1. A retaining apparatus for a storage box having a cavity with an open end defined by a plurality of sidewalls extending from a substantially closed end portion, at least one sidewall having a first flap adjacent to the open end and defining a first plane and adapted, in a closed condition, to foldably overlap a second flap disposed adjacent to the open end on an opposing sidewall and defining a second plane, the retaining apparatus comprising:

a first tab coupled to the first flap with a pivoting structure and having a free end defining a part-circular shape with a diameter and a circumferential outer edge, the first tab being pivotally movable out of the first plane and through the second plane to a retaining position when the first and second flaps are disposed in the closed condition;

the second flap having an aperture formed therein having a shape and size substantially the same as that of the free end with a peripheral edge and disposed in substantial alignment with the free end when the first and second flaps are disposed in the closed condition;

wherein the first tab and the peripheral edge of the aperture cooperate to retain the first and second flaps in the closed condition when the first tab is pivoted to the retaining position and the outer edge is disposed in abutting relationship with the peripheral edge at first and second diametrically opposed locations on the free end and defining a chord therebetween having a length less than the diameter and disposed between the diameter and the pivoting structure; and finger insert apertures adapted to receive a user's finger and disposed respectively on the first and second flaps and being in substantial alignment with each other when the first and second flaps are disposed in the closed condition, the finger insert aperture on the first flap being disposed adjacent to an end of the first tab opposite from the pivoting structure.

2. The closing apparatus as claimed in claim 1 wherein each finger insert aperture has a substantially arcuate shape.

3. A unitary one-piece wall structure openable at one end, comprising:

first and second flaps adjacent to the end and respectively defining first and second planes and respectively being foldable to an overlapping condition for closing the end; a first tab coupled to the first flap with a pivoting structure and having a free end defining a part-circular shape with a diameter and a circumferential outer edge, the first tab being pivotally movable out of the first plane and through the second plane to a retaining position when the first and second flaps are disposed in the overlapping condition;

the second flap having an aperture formed therein having a shape and size substantially the same as that of the free end with a peripheral edge and disposed in substantial alignment with the free end when the first and second flaps are disposed in the overlapping condition; and finger insert apertures adapted to receive a user's finger and disposed respectively on the first and second flaps and being in substantial alignment when the first and second flaps are disposed in the overlapping condition, the finger insert aperture on the first flap being disposed adjacent to an end of the first tab opposite from the pivoting structure;

wherein the first tab and the peripheral edge of the aperture cooperate to retain the first and second flaps in the overlapping condition when the first tab is pivoted to the retaining position and the outer edge is disposed in abutting relationship with the peripheral edge at first and second diametrically opposed locations on the free end and defining a chord therebetween having a length less than the diameter and disposed between the diameter and the pivoting structure.

4. The wall structure as claimed in claim 3 wherein the second flap has a second tab disposed in the aperture and having substantially the same size and shape as the first tab, the second tab being coupled to the second flap by a second folding line and pivotally moveable out of the second plane to a retaining position.

5. The wall structure as claimed in claim 3 wherein each finger insert aperture has a substantially arcuate shape.

6. A retaining structure for retaining first and second sheets of material in an overlapping condition and defining respective first and second planes, comprising:

a first tab coupled to the first sheet with a pivoting structure and having a free end defining a part-circular shape with a diameter and a circumferential outer edge, the first tab being pivotally moveable out of the first plane and through the second plane to a retaining position when the first and second sheets are disposed in the overlapping condition;

the second flap having an aperture formed therein having a shape and size substantially the same as that of the free end with a peripheral edge and disposed in substantial alignment with the free end when the first and second sheets are disposed in the overlapping condition;

wherein the first tab and the peripheral edge of the aperture cooperate to retain the first and second sheets in the overlapping condition when the first tab is pivoted to the retaining position and the outer edge is disposed in abutting relationship with the peripheral edge at first and second diametrically opposed locations on the free end and defining a chord therebetween having a length less than the diameter and disposed between the diameter and the pivoting structure; and respective insert apertures disposed respectively on the first and second sheets and being in substantial alignment when the sheets are disposed in the overlapping condition, the insert aperture on the first sheet being disposed adjacent to an end of the first tab opposite from the pivoting structure.

* * * * *